US005165761A

United States Patent [19]

Dirksing

[11] Patent Number: 5,165,761

[45] Date of Patent: Nov. 24, 1992

[54] METHOD OF MAKING IMPROVED TOOTHBRUSH HAVING MULTI-LEVEL TUFTS WITH SUBSTANTIALLY UNIFORMLY ROUNDED BRISTLE ENDS IN EACH TUFT

[75] Inventor: Robert S. Dirksing, Cincinnati, Ohio

[73] Assignee: The Procter & Gamble Company, Cincinnati, Ohio

[21] Appl. No.: 814,946

[22] Filed: Dec. 30, 1991

[51] Int. Cl.[5] ..... A46D 1/00

[52] U.S. Cl. ..... 300/21

[58] Field of Search ..... 300/21, 17

[56] References Cited

U.S. PATENT DOCUMENTS

| | | | |
|---|---|---|---|
| Re. 27,455 | 8/1971 | Lewis, Jr. . | |
| 74,560 | 2/1868 | Maury . | |
| 105,373 | 7/1870 | Ruset . | |
| 132,031 | 10/1872 | Stone | 300/17 |
| 764,898 | 7/1904 | Mumford . | |
| 803,995 | 11/1905 | Davenport . | |
| 958,371 | 5/1910 | Danek . | |
| 982,340 | 1/1911 | Young et al. | 300/17 X |
| 1,018,927 | 2/1912 | Sarrazin . | |
| 1,382,681 | 6/1921 | Segal . | |
| 2,035,709 | 3/1936 | Laub et al. . | |
| 2,066,068 | 12/1936 | Cooke . | |
| 2,227,126 | 12/1940 | Cooke . | |
| 2,303,800 | 12/1942 | Swann . | |
| 2,426,328 | 8/1947 | Wandel et al. . | |
| 2,488,873 | 11/1949 | Maynard . | |
| 2,587,792 | 3/1952 | Von Sivers . | |
| 2,643,158 | 6/1953 | Baldanza . | |
| 2,653,056 | 9/1953 | Montero et al. . | |
| 2,664,316 | 12/1953 | Winslow, Jr. et al. . | |
| 2,710,774 | 6/1955 | Baumgartner . | |
| 2,783,490 | 3/1957 | Kutik . | |
| 3,233,943 | 2/1966 | Peterson | 300/17 |
| 3,408,112 | 10/1968 | Piotrowski . | |
| 3,451,173 | 6/1969 | Hazelton | 300/17 X |
| 3,471,202 | 10/1969 | Lewis, Jr. . | |
| 3,545,025 | 12/1970 | O'Connell . | |
| 3,563,609 | 2/1971 | Lewis, Jr. . | |
| 3,580,761 | 5/1971 | Boultinghouse . | |
| 3,589,774 | 6/1971 | Hazelton | 300/17 |

(List continued on next page.)

FOREIGN PATENT DOCUMENTS

| | | | |
|---|---|---|---|
| 507794 | 11/1954 | Canada | 300/21 |
| 086412 | 8/1983 | European Pat. Off. . | |
| 0078569 | 11/1983 | European Pat. Off. . | |
| 142885 | 5/1985 | European Pat. Off. . | |

(List continued on next page.)

OTHER PUBLICATIONS

C. Kockapan and W. E. Wetzel, Quality Testing the Ends of Bristles of Toothbrushes for Children, Zahnaerztilche Mitteilungen, 1987, vol. 16, pp. 1740–1745.

Leon M. Silverstone, A scanning electron microscope study of the end rounding of bristles in eight toothbrush types, Quintessence International, 1988, vol. 2 pp. 87–107.

*Primary Examiner*—Mark Rosenbaum
*Assistant Examiner*—Frances Chin
*Attorney, Agent, or Firm*—E. Kelly Linman; Richard C. Witte; Thomas H. O'Flaherty

[57] ABSTRACT

A method of making toothbrushes having bristle tufts with ends in two or more distinct planes, all of said bristle tufts having individual bristles which are substantially uniformly rounded at their free ends. The method of making is a repeated sequence of steps used to attach all of the bristle tufts of the shortest overall length followed by cutting and end rounding of the individual bristles in the first group of tufts while all of the free ends of the bristles are in a first plane. This is done prior to affixing the next group of bristle tufts of greater overall length. The cutting and end rounding sequence is thereafter repeated for each ascending bristle tuft elevation. The final toothbrush bristle contour is a function of the pattern of attachment for each bristle tuft elevation.

7 Claims, 4 Drawing Sheets

U.S. PATENT DOCUMENTS

| | | |
|---|---|---|
| 3,596,999 | 8/1971 | Lewis, Jr. . |
| 3,774,782 | 11/1973 | Lewis, Jr. . |
| 3,799,616 | 3/1974 | Lewis, Jr. . |
| 3,910,637 | 10/1975 | Lewis, Jr. . |
| 4,009,910 | 3/1977 | Lewis, Jr. . |
| 4,109,965 | 8/1978 | Lewis, Jr. . |
| 4,132,449 | 1/1979 | Bergman . |
| 4,355,847 | 10/1982 | Schnekenburger et al. . |
| 4,356,585 | 11/1982 | Protell et al. . |
| 4,390,384 | 6/1983 | Turner . |
| 4,472,853 | 9/1984 | Rauch . |
| 4,592,594 | 6/1986 | d'Argembeau . |
| 4,635,313 | 1/1987 | Fassler et al. . |
| 4,679,273 | 7/1987 | Okin . |
| 4,693,519 | 9/1987 | Lewis, Jr. . |
| 4,696,519 | 9/1987 | Lewis, Jr. . |
| 4,749,233 | 6/1988 | Weihrauch . |
| 4,762,373 | 8/1988 | Amos et al. . |
| 4,766,633 | 8/1988 | Clark . |
| 4,776,054 | 10/1988 | Rauch . |
| 4,776,055 | 10/1988 | Nelson . |
| 4,804,232 | 2/1989 | Weihrauch . |
| 4,979,782 | 12/1990 | Weihrauch . |

FOREIGN PATENT DOCUMENTS

| | | | |
|---|---|---|---|
| 149996A | 7/1985 | European Pat. Off. . | |
| 0247224 | 12/1987 | European Pat. Off. . | |
| 0150785 | 12/1989 | European Pat. Off. . | |
| 815793 | 10/1951 | Fed. Rep. of Germany | 300/17 |
| 830339 | 2/1952 | Fed. Rep. of Germany . | |
| 845933 | 6/1953 | Fed. Rep. of Germany . | |
| 951357 | 10/1956 | Fed. Rep. of Germany | 300/17 |
| 1049823 | 2/1959 | Fed. Rep. of Germany . | |
| 1532809 | 4/1970 | Fed. Rep. of Germany . | |
| 2335468 | 2/1975 | Fed. Rep. of Germany . | |
| 1604673 | 9/1975 | Fed. Rep. of Germany . | |
| 2840833 | 4/1980 | Fed. Rep. of Germany . | |
| 2922877 | 12/1980 | Fed. Rep. of Germany . | |
| 8427132.9 | 5/1985 | Fed. Rep. of Germany . | |
| 3433763C1 | 2/1986 | Fed. Rep. of Germany . | |
| 3505972 | 8/1986 | Fed. Rep. of Germany . | |
| 3533533 | 9/1986 | Fed. Rep. of Germany . | |
| 24783 | 8/1951 | Finland . | |
| 695325 | 12/1930 | France . | |
| 794580 | 2/1936 | France . | |
| 1057279 | 3/1954 | France . | |
| 1467935 | 2/1967 | France . | |
| 2251293 | 11/1973 | France | 300/21 |
| 458320 | 5/1949 | Italy | 300/17 |
| WO89/05706 | 6/1989 | PCT Int'l Appl. . | |

METHOD OF MAKING IMPROVED TOOTHBRUSH HAVING MULTI-LEVEL TUFTS WITH SUBSTANTIALLY UNIFORMLY ROUNDED BRISTLE ENDS IN EACH TUFT

TECHNICAL FIELD

The present invention pertains to toothbrushes having bristle tufts ending in two or more distinct planes, the free ends of the individual bristles in all of said tufts exhibiting a generally rounded form. In particular, the present invention pertains to a method of making such toothbrushes by incrementally attaching, trimming, and end rounding successive levels of bristle tufts, starting with a lowest level and proceeding stepwise to successively higher levels of bristle tufts.

BACKGROUND OF THE INVENTION

Use of a brush to clean teeth is a generally accepted means of maintaining oral hygiene. Consequently, many different styles and types of toothbrushes are either disclosed in the art or available in the market. Different combinations of bristle stiffness, handle design, brush head profile, bristle contour and the like provide varying degrees of cleaning, comfort, and, unfortunately, tooth and gum tissue damage.

It is generally known that toothbrushes with contoured bristle heights, such as a sinusoidal wave form, enable the bristles to more easily penetrate the space between the teeth, thereby providing improved cleaning.

It is also generally known that end rounding of individual bristles reduces tooth and gum tissue damage by removing the sharp edges which result from the bristle trimming operation. Positioning the free ends of the bristles against an orbital grinder is a very effective means to achieve end rounding when the free ends of the bristles terminate within a common plane. However, with a contoured brush insufficient penetration of the grinder into the bristle tufts tends to round only the longest bristles. Conversely, grinder penetration sufficient to end round the shorter bristles damages and distorts the longer bristles.

Complex grinding systems have been developed to attempt to end round bristles after they have been attached to the brush head and trimmed to the desired contour. For example, U.S. Pat. No. 2,227,126 issued to Cooke on Dec. 31, 1940 discloses a complex combination of contoured grinding wheels, blades, and oscillating motions used in an attempt to end round the tips of bristles which are not within a common plane. The disclosed process is expensive, marginally effective, and limited to relatively simple contours.

U.S. Pat. No. 2,426,328 issued to Wandel et al. on Aug. 26, 1947 discloses a thermal process for end rounding bristles. However, the thermal process, especially for a contoured brush pattern, is a very random process. Thickening of the bristle ends or fusion of the bristle ends to one another typically results. Both of these characteristics are undesirable in the finished toothbrush. Means to remove such thickenings or fusions, such as with a steel brush, are disclosed. However, such removal techniques tend to produce bristle tufts wherein the tips of the individual bristles are no longer uniformly end rounded.

U.S. Pat. No. 4,979,782 issued to Weihrauch on Dec. 25, 1990 discloses a process for producing a contoured brush having individual bristle ends that are substantially uniformly rounded and located in a contour differing from that of the bristle carrier. This is accomplished by a bristle tuft clamp system. The disclosed process includes the steps of: clamping the bristles while the utilization-side ends are in a flat plane; substantially uniformly rounding the utilization-side ends of the bristles while they are clamped in the flat plane; loosening the clamp restraining the bristles; axially displacing the utilization-side ends of the bristles relative to one another to produce the desired contour; and thereafter fastening the opposite ends of the bristles to the bristle carrier. Although sophisticated manufacturing systems of the type generally disclosed in U.S. Pat. No. 4,979,782 permit three-dimensional profiling of individual bristle tufts as well as three-dimensional profiling of the bristle tufts relative to one another, they differ markedly from most commercially available toothbrush production systems. In addition they require operating personnel having a high level of technical competence.

OBJECTS OF THE INVENTION

It is therefore an object of the present invention to provide a relatively simple method by which it is possible to manufacture toothbrushes having bristle tufts with two or more levels wherein the ends of the individual bristles within all of the tufts exhibit a generally rounded form.

DISCLOSURE OF THE INVENTION

In accomplishing the aforementioned objective, the present invention provides a method of making toothbrushes exhibiting ascending levels of bristle tufts, the ends of each of the individual bristles within said tufts exhibiting a generally rounded form. The production of each level of bristle tufts includes the steps of attaching bristle tufts to the brush head of the toothbrush, trimming all of the bristle ends to a generally common plane and end rounding all of the bristles within said common plane by conventional means, such as orbital grinding. By repeating the bristle tuft attaching, trimming and end rounding steps for each successive tuft level, various bristle contours and patterns may be produced with good end rounding of the bristle tips in all levels.

The placement of the individual bristle tufts which constitute a particular level determines the final contour and/or pattern of the completed brush.

BRIEF DESCRIPTION OF THE DRAWINGS

While the specification concludes with claims that particularly point out and distinctly claim the subject matter regarded as forming the present invention, it is believed that the invention will be better understood from the following description and drawings in which:

DETAILED DESCRIPTION OF THE INVENTION

Figure 1:
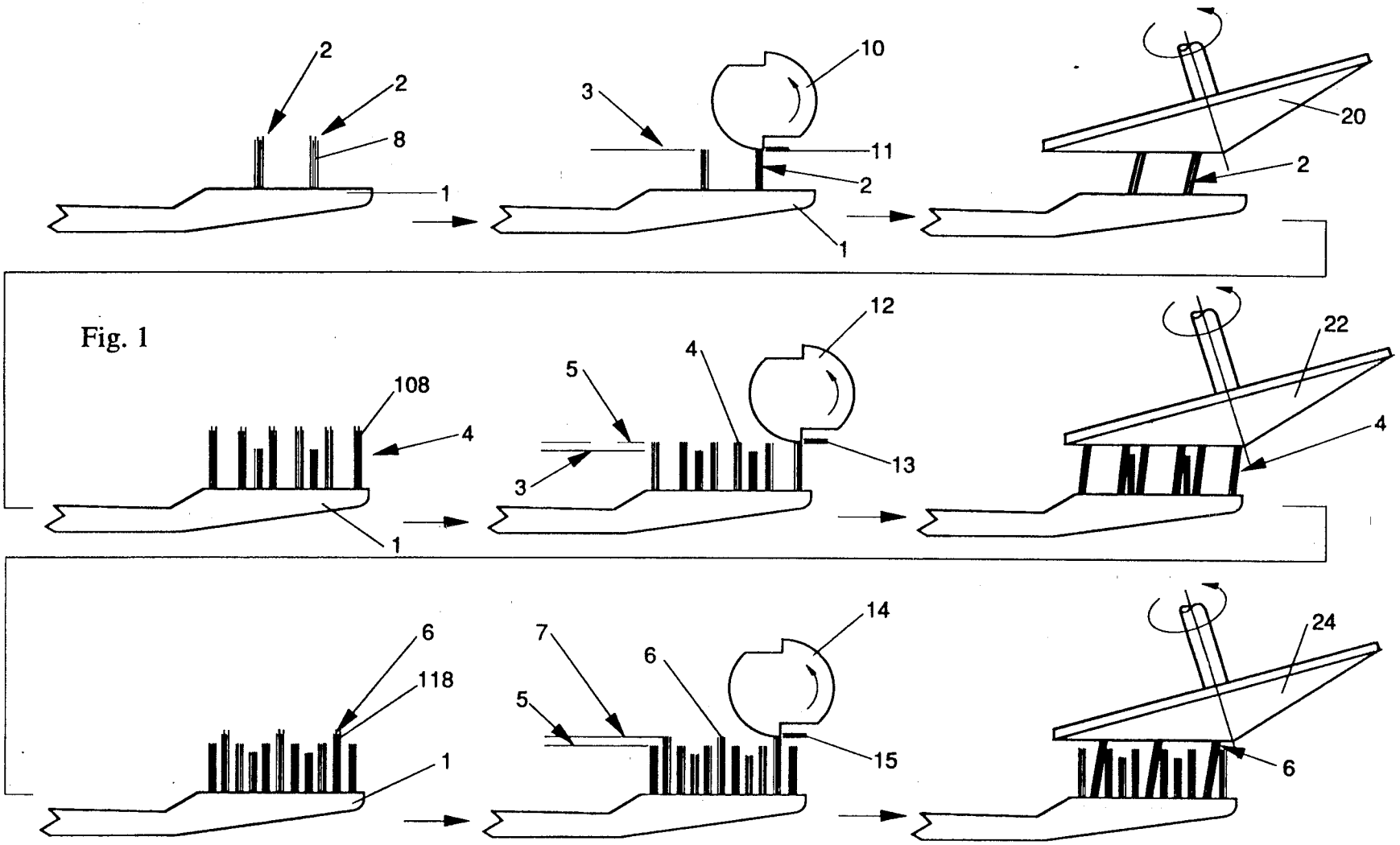
FIG. 1 is a simplified schematic flow diagram of a preferred process for making an improved toothbrush of the present invention.

In FIG. 1 there is shown a simplified schematic flow diagram of a particularly preferred process for making multilevel toothbrushes with substantially uniformly rounded bristle tips in each of its bristle tufts. The illustrated process of the present invention is comprised of three repetitive operations: attaching the bristle tufts by any of several means well known in the art, trimming the bristle tufts to a common plane and rounding substantially all of the free ends of the individual bristles in that particular plane before obstructing access of the end rounding means, e.g., a grinder, to the common plane. The sequence in the schematic diagram of FIG. 1 begins with the attachment of bristle tufts 2 onto brush head 1. The bristle tufts may be attached by means of welding, bonding, stapling, or the like. The particular means of securement is non-critical to the practice of the present invention.

The next step in the process is trimming the free ends of bristle tufts 2 to a substantially common plane 3. In the diagram of FIG. 1, trimming is accomplished by means of a rotary cutter 10 and an anvil 11. Traversing the brush head 1 at a predetermined distance and angle relative to the cutting edges of the rotary cutter 10 and anvil 11 causes the free ends of each of the bristles 8 contained in bristle tufts 2 to be trimmed to a substantially common plane 3. However, the trimming operation leaves many of the free ends of the individual bristles 8 contained within the bristle tufts 2 with sharp and jagged edges.

The next step in the process is end rounding of the individual bristles 8 within bristle tufts 2. End rounding in the schematic flow diagram of FIG. 1 is preferably accomplished by means of an orbital grinder 20, such as is generally disclosed in U.S. Pat. No. 4,979,782 issued to Weihrauch on Dec. 25, 1990 and hereby incorporated herein by reference. Orbital grinder 20 rotates about a first generally central axis of the grinding surface, as represented by the rotational arrow in FIG. 1. In addition it rotates about a second axis (not shown) which causes the free ends of bristle tufts 2 to be swept about in small 360 degree circles so that the grinding surface of the grinder 20 removes the edges of the free ends of the individual bristles 8 in bristle tufts 2. Alternatively, methods other than orbital grinding, such as chemical means known in the art, may be employed to end round the bristle ends while they are all in a common plane.

Figure 2A:
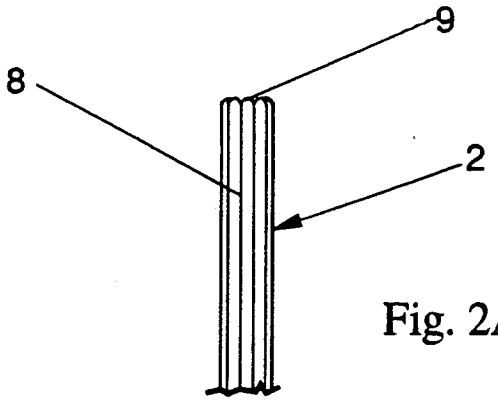
FIG. 2A is a further enlarged view of the rounded bristle ends at the location corresponding to inset 2A in FIG. 2.
Figure 2:
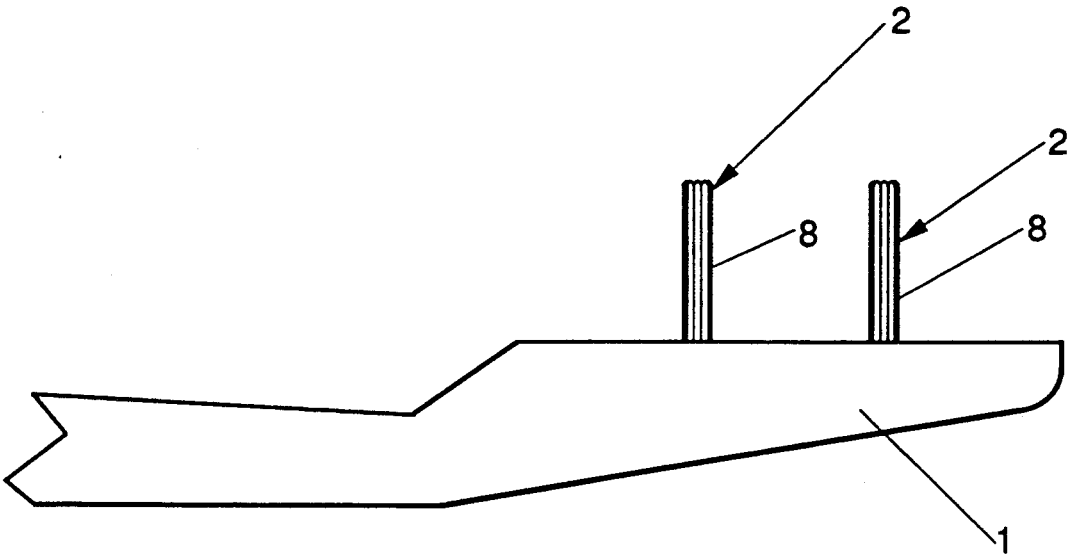
FIG. 2 is an enlarged partial side view of the toothbrush of FIG. 1 after a first level of bristle tufts has been attached.

In FIG. 2, there is shown an enlarged side view of brush head 1 after the bristle tufts 2 have been attached. FIG. 2A is a greatly enlarged view of the inset 2A shown in FIG. 2. Bristle tuft 2 in FIG. 2A is comprised of individual bristles 8. After the end rounding step, the individual bristles 8 exhibit a generally rounded form 9.

Figure 3:
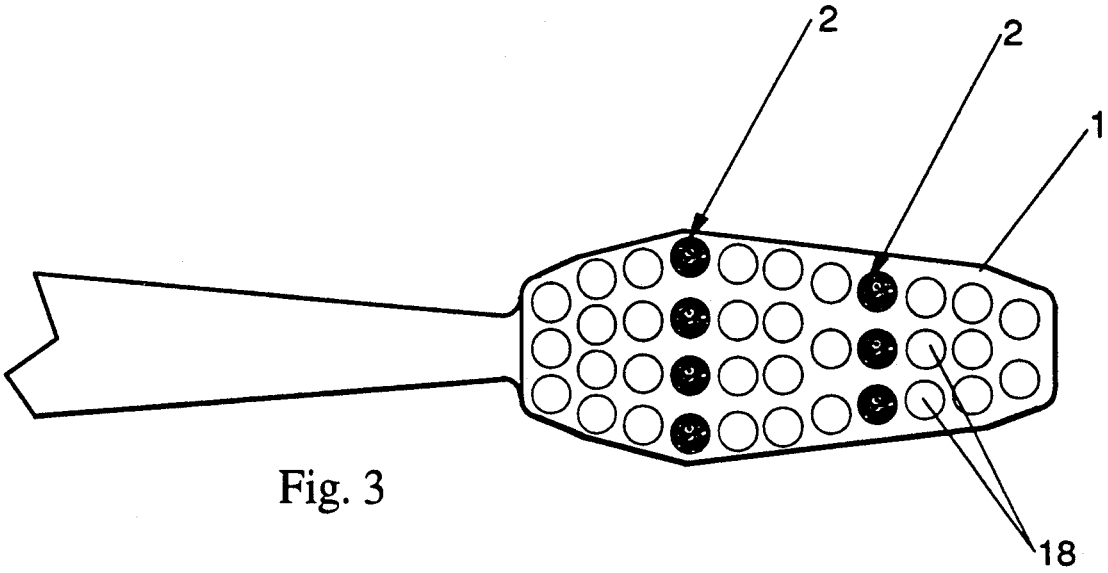
FIG. 3 is a partial plan view of the toothbrush of FIG. 2 after the first level of bristle tufts has been attached.

FIG. 3 is a plan view of brush head 1, wherein it can be readily seen that the two columns of bristle tufts 2 are actually comprised of multiple bristle tufts 2 extending laterally across the width of the brush head As can also be seen from FIG. 3, pre-manufactured holes 18 in brush head 1 are sites for subsequent bristle tuft attachment.

The next step of the process in the schematic flow diagram of FIG. 1 is attachment of slightly longer bristle tufts 4 containing bristle filaments 108. Following the second attachment step is a second trimming step wherein rotary cutter 12 and anvil 13 trim the free ends of the bristles 108 of bristle tufts 4 to a substantially common plane 5. However, plane 5 is at a higher elevation than plane 3 relative to brush head 1. Following the trimming step of bristle tufts 4 is a second end rounding step accomplished by means of another orbital grinder 22, which is generally similar to orbital grinder 20.

Figure 4:
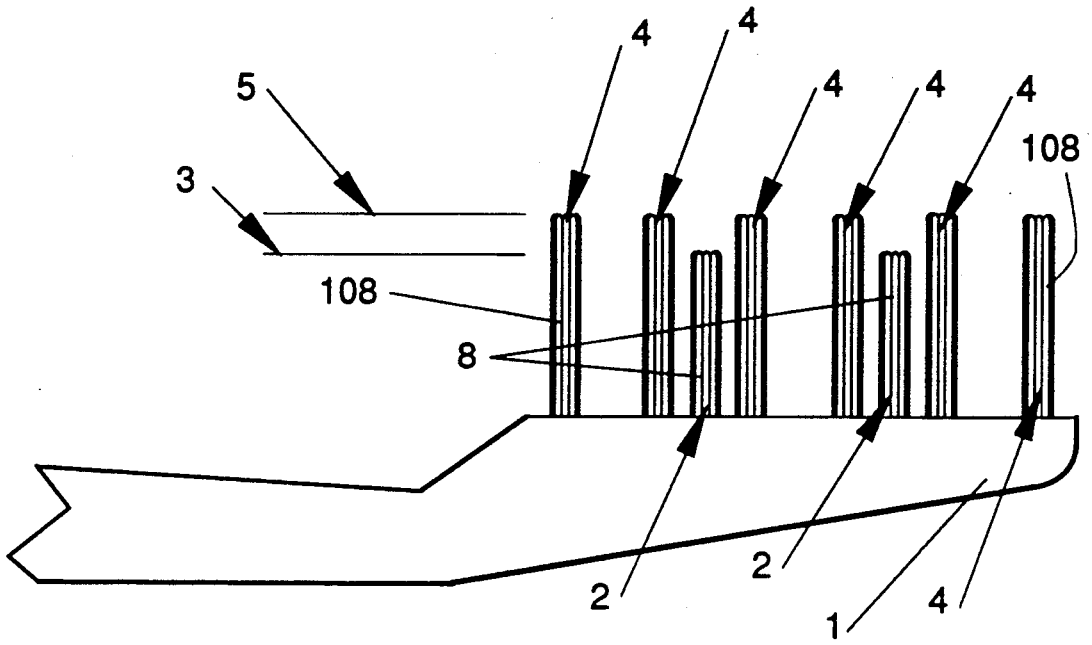
FIG. 4 is a partial side view of the toothbrush of FIG. 1 after a second higher level of bristle tufts has been attached.

In FIG. 4, there is shown an enlarged side view of brush head 1 after bristle tufts 2 and bristle tufts 4 have been attached, trimmed, and the individual bristles in the tufts end rounded. Note the free ends of bristle tufts 2 terminate at generally common plane 3 and the free ends of bristle tufts 4 terminate at generally common plane 5.

Figure 5:
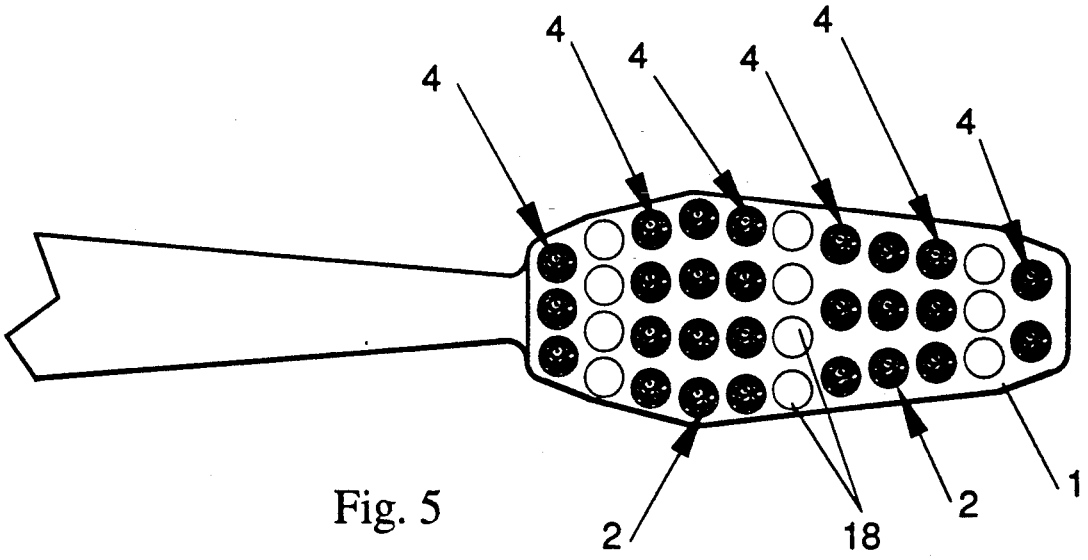
FIG. 5 is a partial plan view of the toothbrush of FIG. 4 after the second higher level of bristle tufts has been attached.

FIG. 5 is a plan view of brush head 1 wherein it can be readily seen that each of the six columns of bristle tufts shown in FIG. 4 are also comprised of multiple bristle tufts 4 extending laterally across the width of the brush head 1. As can also be seen from FIG. 5, pre-manufactured holes 18 in brush head 1 are sites for subsequent bristle tuft attachment.

The next step of the process in the schematic flow diagram of FIG. 1 is attachment of slightly longer bristle tufts 6 containing bristle filaments 118. Following the third attachment step is a third trimming step wherein rotary cutter 14 and anvil 15 trim the free ends of the bristles 118 in bristle tufts 6 to a substantially common plane 7. Plane 7 is at a higher elevation than plane 5 relative to brush head 1. Following the trimming step of bristle tufts 6 is a third end rounding step accomplished by means of orbital grinder 24, which is generally similar to orbital grinders 20 and 22.

Figure 6:
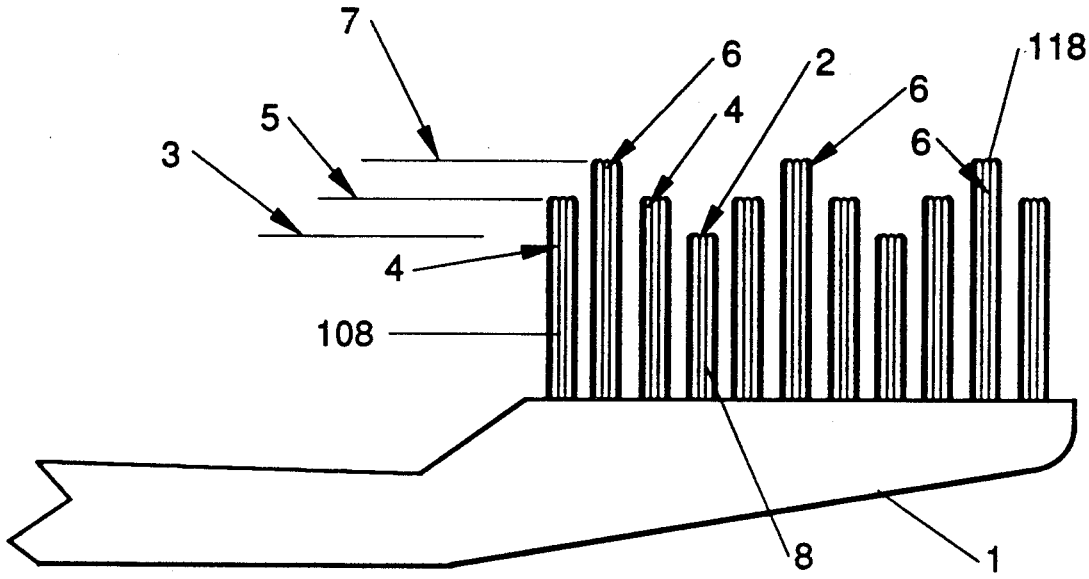
FIG. 6 is a partial side view of the toothbrush of FIG. 1 after a third and still higher level of bristle tufts has been attached.

In FIG. 6, there is shown an enlarged side view of brush head 1 after bristle tufts 2, bristle tufts 4 and bristle tufts 6 have all been attached, trimmed, and the individual bristles in the tufts end rounded. Note the free ends of bristle tufts 2 terminate at generally common plane 3, the free ends of bristle tufts 4 terminate at generally common plane 5 and the free ends of bristle tufts 6 terminate at generally common plane 7. The finished brush exhibits a generally sinusoidal profile, yet the free ends of the bristles all exhibit a generally rounded form 9 generally similar to that shown in FIG. 2A. The overall profile of the bristle tufts can, of course, be altered as desired from that shown to meet specific performance objectives.

Figure 7:
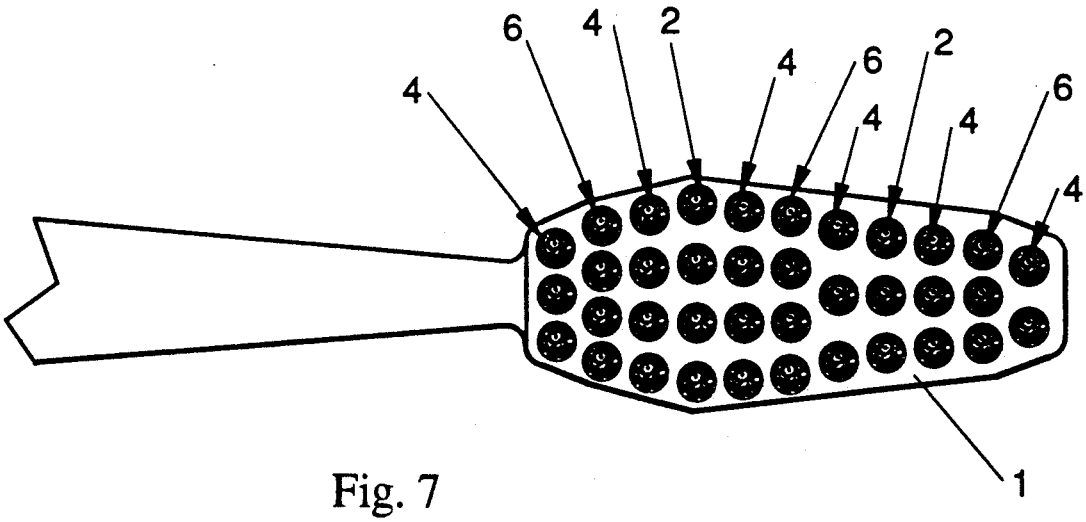
FIG. 7 is a partial plan view of the toothbrush of FIG. 6 after the third still higher level of bristle tufts has been attached.

FIG. 7 is a plan view of brush head 1 wherein it can be readily seen that each of the three columns of bristle tufts shown in FIG. 5 are also comprised of multiple bristle tufts 6 extending laterally across the width of the brush head 1. As can also be seen from FIG. 6, all of the pre-manufactured holes 18 in brush head 1 are now fully occupied by bristle tufts.

While particular embodiments of the present invention have been illustrated and described, it will be obvious to those skill in the art that various changes and modifications can be made without departing from the spirit and scope of the invention, and it is intended to cover in the appended claims all such modifications that are within the scope of this invention.

What is claimed is:

1. A method of making a toothbrush having bristle tufts with bristle ends in distinct planes, all of said bristle tufts having individual bristles which are substantially uniformly rounded at their free ends, said method comprising the steps of:

(a) affixing a first group of bristle tufts to a toothbrush head;

(b) cutting all of said tufts so that the free ends of the bristles contained in said first group of bristle tufts are all in a first plane;

(c) subjecting the free ends of said individual bristles in said tufts to an end rounding process while said free ends of said bristles are all in said first plane to produce a generally rounded form on the free ends of said bristles;

(d) affixing at least a second group of bristle tufts to said brush head;

(e) cutting the ends of said second group of bristle tufts so that the free ends of the bristles contained in said second group of bristle tufts are all in a second plane which is at a higher elevation than said first plane relative to said brush head; and (f) subjecting the free ends of said individual bristles contained in said second group of bristle tufts to an end rounding process while said free ends of said bristles in said second group of bristle tufts are all in said second plane to produce a generally rounded form on the free ends of said bristles without disturbing the free ends of the bristles in said first plane.

2. The process of claim 1 wherein each of said end rounding processes comprises mechanical grinding.

3. The method of claim 2, wherein said mechanical grinding processes in said first and second planes are each performed by an orbital grinder.

4. The method of claim 1, wherein each of said end rounding processes are performed by immersing for a limited period of time and to a predetermined depth the free ends of the bristles contained in said first and second groups of bristle tufts, respectively, into a chemical solvent capable of at least partially dissolving said bristles.

5. The method of claim 1, further including the steps of:

(g) affixing a third group of bristle tufts to said brush head;

(h) cutting the ends of said third group of bristle tufts so that the free ends of said bristles in said third group of bristle tufts are all in a third plane which is at a higher elevation than said second plane relative to said brush head; and (i) subjecting the free ends of said individual bristles contained in said third group of bristle tufts to an end rounding process while said free ends of said bristles in said third group of bristle tufts are all in said third plane to produce a generally rounded form on the free ends of said bristles without disturbing the free ends of said bristles in said first and second planes.

6. The method of claim 5, wherein said first, second and third groups of bristle tufts are so positioned adjacent one another along the longitudinal axis of said brush head that they collectively produce a generally sinusoidal profile when said brush head is viewed from a side elevation.

7. The method of claim 6, wherein the points of maximum amplitude in said sinusoidal profile substantially coincide with the gaps formed between the user's teeth.

* * * * *

UNITED STATES PATENT AND TRADEMARK OFFICE

CERTIFICATE OF CORRECTION

PATENT NO. : 5,165,761

DATED : November 24, 1992

INVENTOR(S) : Robert S. Dirksing

It is certified that error appears in the above-identified patent and that said Letters Patent is hereby corrected as shown below:

Column 4, line 4, after "head" insert -- 1. -- .

Signed and Sealed this

Twenty-sixth Day of October, 1993

*Attest:*

Bruce Lehman

BRUCE LEHMAN

*Attesting Officer*

*Commissioner of Patents and Trademarks*